US006811383B2

(12) United States Patent
Maier

(10) Patent No.: US 6,811,383 B2
(45) Date of Patent: Nov. 2, 2004

(54) OIL CATCHING DEVICE AND OIL PUMP FOR AN INTERNAL-COMBUSTION ENGINE, AND METHOD OF MAKING AND USING SAME

(75) Inventor: Frank Maier, Ditzingen-Hirschlanden (DE)

(73) Assignee: Dr. Ing. h.c.F. Porsch AG, Stuttgart (DE)

( * ) Notice: Subject to any disclaimer, the term of this patent is extended or adjusted under 35 U.S.C. 154(b) by 0 days.

(21) Appl. No.: 10/307,512

(22) Filed: Dec. 2, 2002

(65) Prior Publication Data

US 2003/0152464 A1 Aug. 14, 2003

(30) Foreign Application Priority Data

Dec. 1, 2001 (DE) ..... 101 59 090

(51) Int. Cl.[7] ..... F01M 11/08; F04B 25/00

(52) U.S. Cl. ..... 417/251; 417/307; 184/6.21; 184/6.23

(58) Field of Search ..... 417/25, 32, 33, 417/34, 35, 36, 244–250, 251, 252, 307, 308, 309, 310, 360, 361, 362, 559, 569; 123/41.86, 48 R, 190.3, 195 A, 195 C, 195 P, 195 R, 196 S, 198 E, 48 P, 700, 651; 184/6.21, 6.22, 6.23, 6.28

(56) References Cited

U.S. PATENT DOCUMENTS 2,440,815 A * 5/1948 Wharam et al. ..... 184/6.2
4,296,716 A * 10/1981 Hofbauer et al. ..... 123/195 C
4,586,468 A * 5/1986 Dzioba ..... 123/198 C
2001/0037788 A1 * 11/2001 Okuda et al. ..... 123/195 C

FOREIGN PATENT DOCUMENTS

| | | | |
|---|---|---|---|
| DE | 10014368 A1 | | 10/2001 |
| DE | 100 14 368 | | 10/2001 |
| DE | 100 34 400 | | 1/2002 |
| EP | WO 01/71168 A1 | * | 9/2001 |
| JP | 03237207 | | 10/1991 |
| JP | 403237207 | * | 10/1991 |
| JP | 05050025 | | 3/1993 |
| JP | 05059925 | | 3/1993 |

* cited by examiner

*Primary Examiner*—Charles G. Freay
(74) *Attorney, Agent, or Firm*—Crowell & Moring LLP

(57) ABSTRACT

An oil catching device and an oil pump for an internal-combustion engine are provided, having an oil catching housing which is arranged below a crankcase and which has at least two oil collecting spaces, in a first oil collecting space an oil pump being arranged which has two pump stages, at whose two suction stages one oil suction pipe, respectively, is connected. The first oil suction pipe reaches in the first oil collecting space in order to deliver the lubricating oil by way of the delivery side of the first pump stage to the consuming devices, and the second oil suction pipe connected with the second suction stage leads to a second oil collecting space. On its top side, the housing of the oil pump has an opening connected with the delivery side of the second pump stage, by way of which opening, the oil suctioned out of the second oil collecting space is delivered into the first oil collecting space. This achieves a defoaming of the suctioned-off lubricating oil.

7 Claims, 4 Drawing Sheets

OIL CATCHING DEVICE AND OIL PUMP FOR AN INTERNAL-COMBUSTION ENGINE, AND METHOD OF MAKING AND USING SAME

BACKGROUND AND SUMMARY OF THE INVENTION

This application claims the priority of German Patent Document DE 101 59 090, filed Dec. 1, 2001, the disclosure of which is expressly incorporated by reference herein.

The invention is based on an oil catching device having an oil catching housing which is arranged below a crankcase and which has at least two oil collecting spaces, in a first oil collecting space, an oil pump being arranged which has two pump stages, at each of two suction stages, one oil suction pipe is connected; a first oil suction pipe reaching in the first oil collecting space in order to deliver lubricating oil by way of a delivery side of a first pump stage to consuming devices; and a second oil suction pipe connected with a second suction state leads to a second oil collecting space. The device also has an oil pump for an internal-combustion engine for suctioning off lubricating oil situated in an oil catching device, comprising an oil pump housing in which at least two pairs of gear wheels or two pairs of rotors are arranged, by rotation of which, at least two pump stages are formed each having a suction side and a delivery side.

In German Patent Document DE 100 14 368, an oil catching device is described as well as an oil pump arranged therein, in the case of which, by way of a double oil pump, the lubricating oil situated in the rearward collecting space is delivered into the actual oil sump of the internal-combustion engine before it is fed to the consuming devices by way of a second pressure or suction stage. Because air is also taken in from the rearward oil collecting space, an oil/air separator in the form of a swirl pot is arranged at the outlet of the second pressure stage, which swirl pot ensures that a large portion of the gas fractions are separated from the lubricating oil before the lubricating oil returns into the first oil collecting space or oil sump. This swirl pot requires additional space which is available only to a limited extent in the oil catching housing, and, in addition, it must be ensured that the oil outlet provided at the lower end of the oil/air separator is situated above the oil level formed in the oil sump.

An aspect of the invention is to provide devices by way of which the air taken in by the oil pump is separated before the lubricating oil is fed to the consuming devices. The devices for the air separation should be space-saving and be constructed such that the oil sump forming in the oil guiding housing does not impair the method of operation of the air separator.

This aspect can be achieved in that on a top side, a housing of the oil pump has an opening connected with a delivery side of a second pump stage, by way of which opening, oil suctioned out of the second oil collecting space is delivered into the first oil collecting space and in that an opening forming a pressure-side outlet leads into a through-shaped bordering shaped out of the oil pump housing.

Through the opening provided on the top side of the oil pump housing at the outlet of the second delivery side, the lubricating oil can flow out of the pressure space and, by way of the oil pump housing, flow off into the first oil collecting space. The lubricating oil has sufficient time for defoaming, so that the gas fraction of the lubricating oil is already considerably reduced when the latter flows into the oil sump.

In preferred embodiments, additional advantageous further developments and improvements are contained of the oil catching device or of the oil pump.

In order to lengthen the time for the self-defoaming of the lubricating oil, it is advantageously provided that the outlet opening situated on the top side of the oil pump housing is enclosed by a trough-type bordering, so that the lubricating oil emerging from the opening is caught in this type of trough until the excess lubricating oil flows off over the trough edge into the oil sump of the internal-combustion engine.

In the housing of the double oil pump, a pressure limiting valve is arranged and whose opening monitored by the valve body also discharges inside the trough-shaped bordering.

The double pump has two pump stages constructed as pairs of gear wheels, the first pump stage being provided for supplying the consuming devices, while the second pump stage returns the oil suctioned from the rearward oil connecting space into the forward oil collecting space.

Other objects, advantages and novel features of the present invention will become apparent from the following detailed description of the invention when considered in conjunction with the accompanying drawings.

DETAILED DESCRIPTION OF THE DRAWINGS

Figure 1:
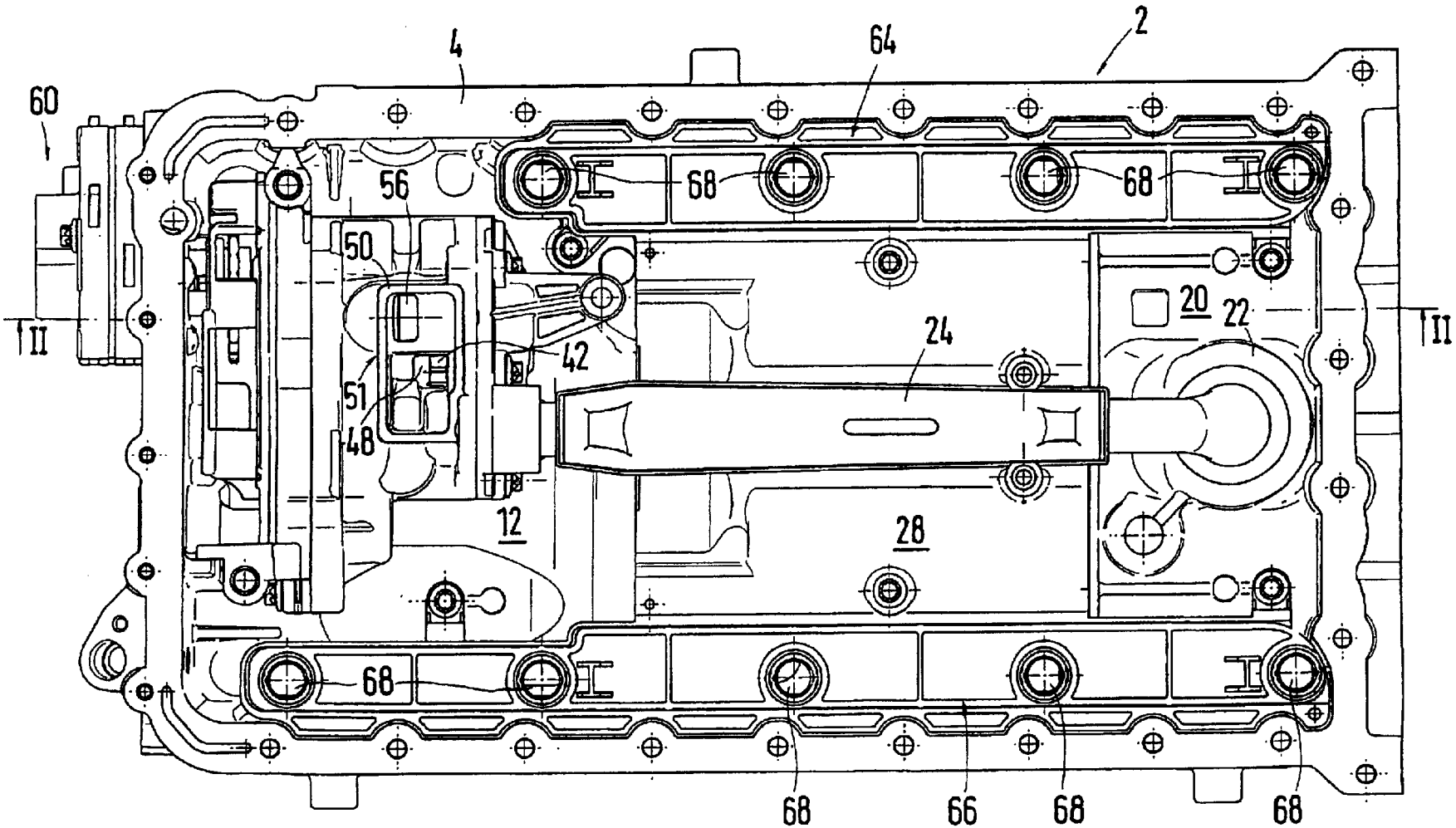
FIG. 1 shows a top view of an oil catching device.
Figure 2:
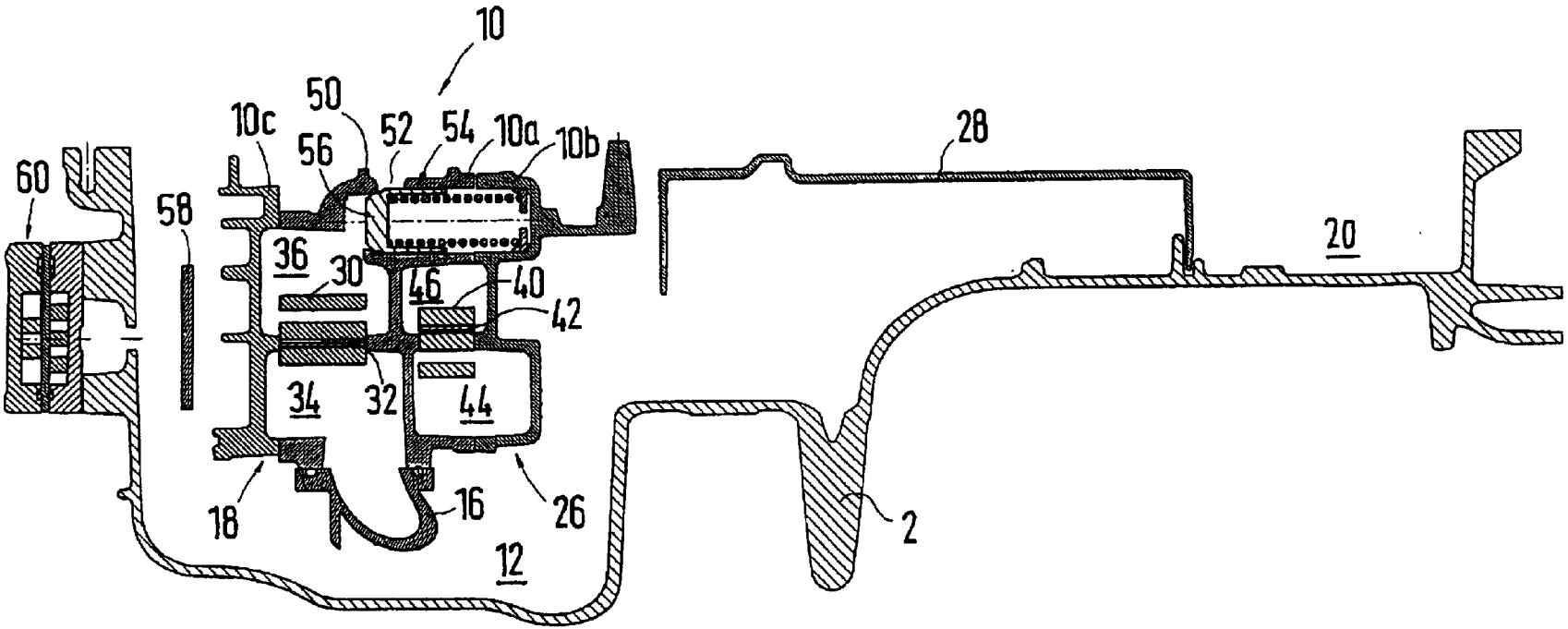
FIG. 2 shows a sectional view along Line II—II in FIG. 1.
Figure 3:
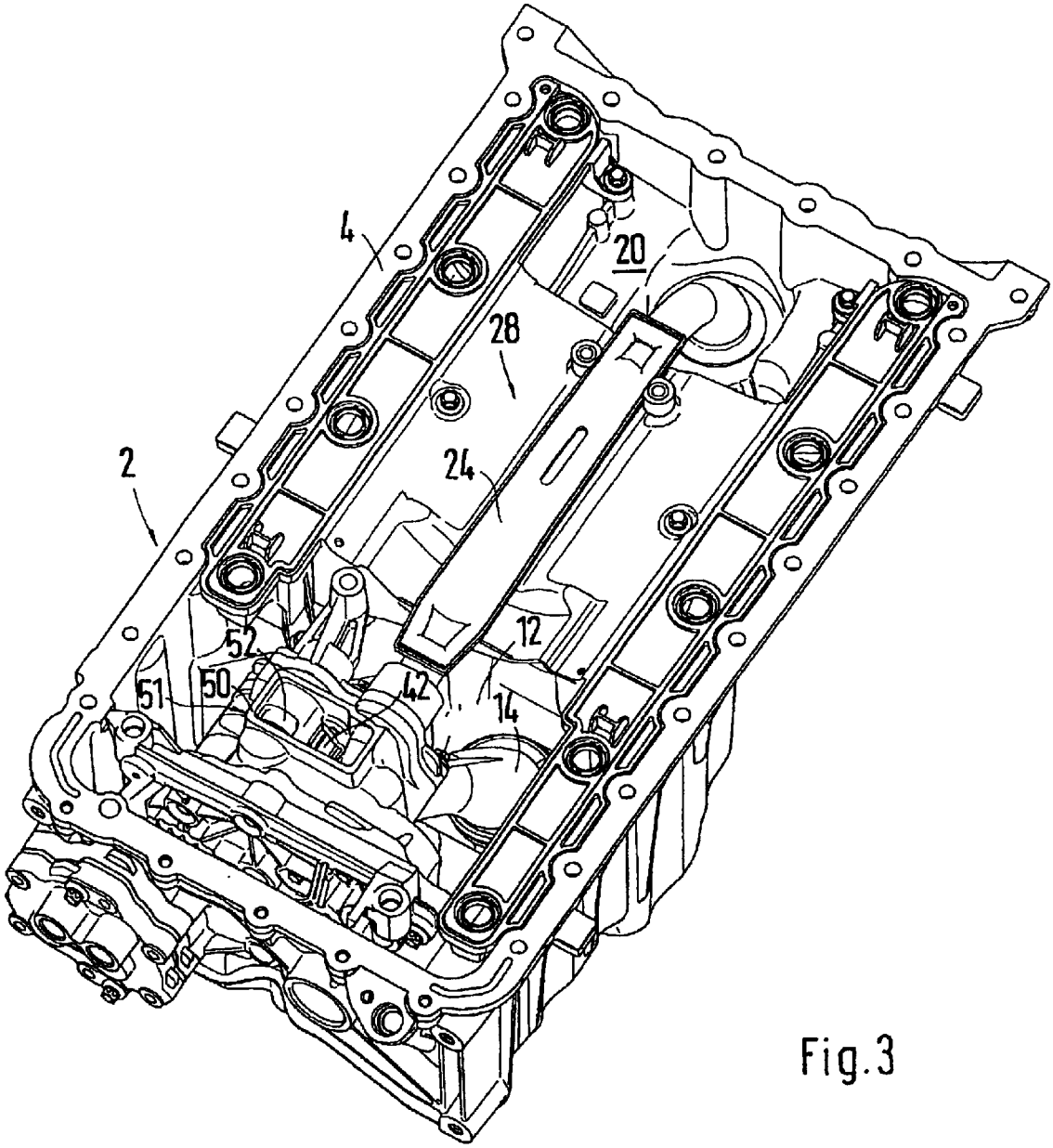
FIG. 3 shows a perspective view of the oil catching device.
Figure 4:
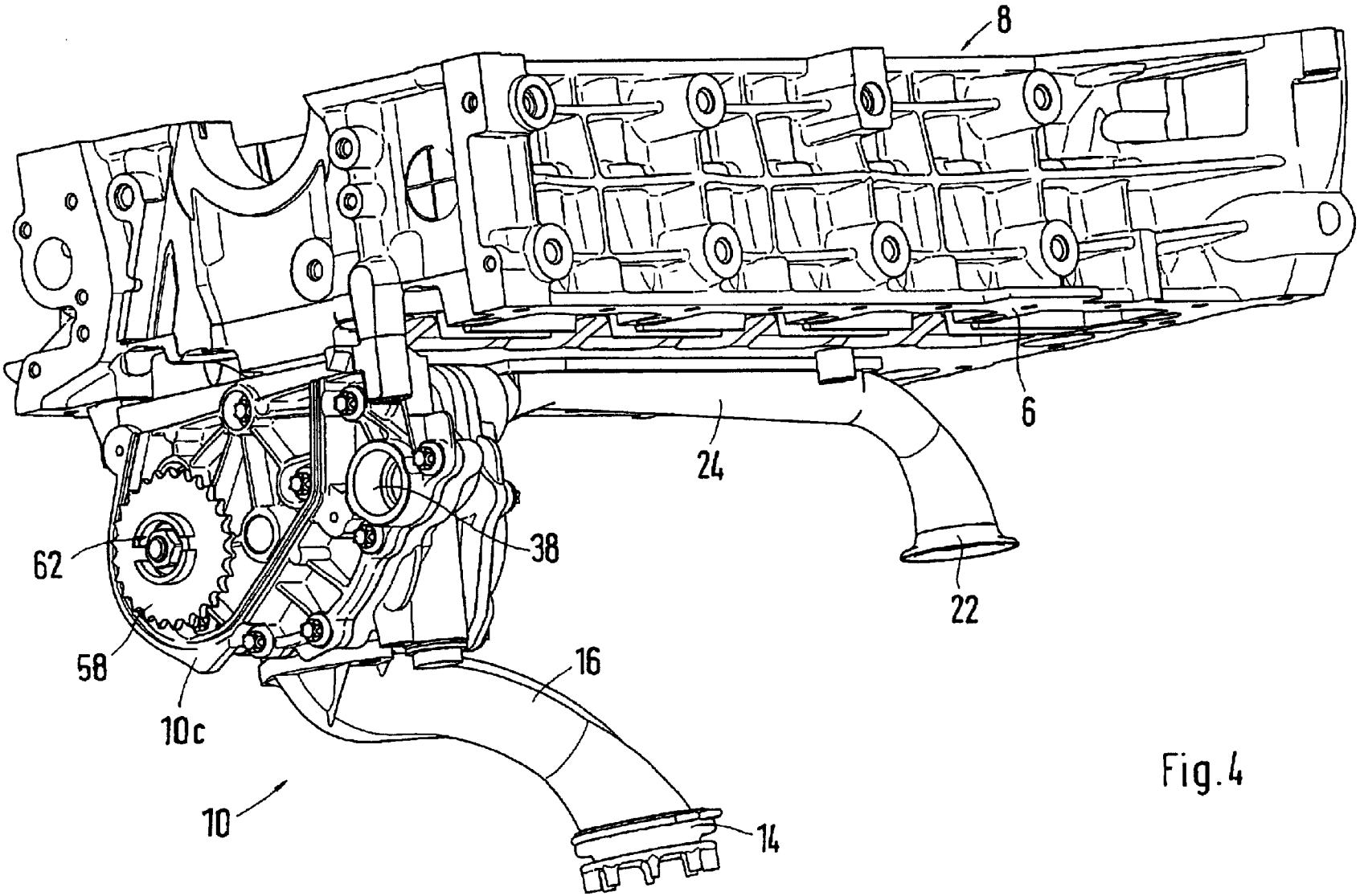
FIG. 4 is a view of an oil pump fastened to a crankcase bottom.

The oil catching housing, as shown in FIG. 1 and in the following called an oil pan 2, in the assembled condition, is fastened by way of its flange surface 4 to a flange surface 6 of a crankcase bottom 8, which is a so-called bedplate. On the bottom side of the crankcase bottom 8, a lubricating oil pump 10 is fastened which is constructed as a double pump. In the oil pan 2, a first oil collecting space 12 is constructed in which the oil required for the lubricating oil supply collects in an oil sump. In the first oil collecting space 12, an oil snorkel 14 is arranged which, by way of a first oil suction pipe 16, leads to a suction side of a first pump stage 18 of the double oil pump 10. In the oil pan 2, a second, rearward oil collecting space 20 is formed, at whose lowest point an oil snorkel 22 is also arranged which is connected by way of a second oil suction pipe 24 with a suction side of a second pump stage 26 of the oil pump 10.

A plastic insertion part 28, which separates the two oil collecting spaces 12 and 20 from one another, is inserted into the oil pan 2. The insertion part 28 is used as an oil barrier and prevents, also in the case of uphill driving of the motor vehicle, that the lubricating oil can flow from the first oil collecting space 12 into the crank space and/or into the second oil collecting space 20. In the second oil collecting space 20, the lubricating oil from the rearward main bearings or connecting rod bearings of the crankshaft is caught which does not directly arrive in the first oil collecting space 12 and is pumped back in to the first oil collecting space 12 by way of the second oil suction pipe 24; analogously thereto, the lubricating oil from the spray nozzles, which are not shown, for the piston cooling.

The lubricating oil pump 10 comprising two pump stages, in a known manner, has two mutually meshing gear wheels

30 and 32 in the first pump stage, which gear wheels separate the pump stage 18 into a suction side 34 and a delivery side 36. The first pump stage 18 has a pressure output 38 by way of which the consuming devices of the internal-combustion engine, such as the main or connecting rod bearings, are supplied with lubricating oil. Two mutually meshing gear wheels 40 and 42 are also arranged in the second pump stage 26 and also separate the pump stage 26 into a suction side 44 and a delivery side 46. The housing of the oil pump 10 is constructed in three parts and comprises a basic housing 10*a* and two cover elements 10*b* and 10*c* fastened to the basic housing. The top side of the basic housing 10*a* has an opening 48 which is connected with the delivery side 46 of the second pump stage 26. The opening 48 is enclosed by a trough-type bordering 50 which forms a type of rising chimney 51.

When the lubricating oil is suctioned from the second oil collecting space 20 by way of the second pump stage 26, it moves from the suction side 44 by way of the outer flanks of the two gear wheels 40 and 42 to the delivery side 46. From there, it is delivered by way of the opening 48 into the rising chimney 51. In the rising chimney 51, a certain amount of lubricating oil can be caught before the portion of the lubricating oil flowing over the trough-type bordering 50 flows off by way of the oil pump housing 10 into the first oil collecting space 12. During the time in which the lubricating oil is held in the rising chimney 51, the lubricating oil can defoam, and the gas constituents of the lubricating oil which have a lower density can be discharged to the outside by way of a crankcase ventilation system which is not shown in detail. As a result of the fact that the lubricating oil flows out above the oil level situated in the oil pan 2, the lubricating oil can flow off along the housing of the lubricating oil pump 10 into the oil sump. The path, which the lubricating oil covers in this case, can be utilized for a further defoaming of the oil before the latter is returned to the consuming devices by way of the first oil suction pipe 16.

On the top side of the basic housing 10*a* of the oil pump 10, another rectangular opening 52 is provided which is monitored by a spring-loaded valve body 56 of the pressure limiting valve 54. In a known manner, the valve body 56 opens up the opening 52 when the oil pressure generated by the first pump stage 18 reaches a defined maximal pressure. When the opening 52 is opened up by the valve body 56, a portion of the lubricating oil delivered by the first pump stage 18 also enters into the rising chimney 51, from where, after a certain time, it also flows over the bordering 50 of the rising chimney 51 and arrives in the first oil collecting space 12.

The two driving gear wheels 30, 40 of the two pump stages 18 and 26 are driven by way of a sprocket 58 which, in turn, is connected by way of a chain drive with a crankshaft timing gear which is not shown. Furthermore, a turbocharger suction pump 60 is flanged to the face of the oil pan 2 and is also driven by way of the sprocket 58. For this purpose, a driving device 62 is provided on the sprocket 58, which driving device 62 engages in the drive shaft of the suction pump 60 which is not shown in detail.

The insertion part 28 is connected with two lateral parts 64 and 66, in which oil return flow openings 68 are arranged. The oil return flow openings 68 arranged in the two lateral parts 64 and 66 each lead into an oil collecting duct, which is not shown, and which both lead into the oil sump below the oil level, whereby it is ensured that, despite the pressure pulsations caused by the crankshaft and piston movements, the lubricating oil rapidly returns from the consuming devices into the first oil collecting space.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Oil catching device for an internal-combustion engine, comprising:

an oil catching housing which is arranged below a crankcase and which has at least two oil collecting spaces, in a first oil collecting space, an oil pump being arranged which has two pump stages, a first oil suction pipe reaching in the first oil collecting space in order to deliver lubricating oil by way of a delivery side of a first pump stage to consuming devices, and a second oil suction pipe connected with a second pump stage and leading to a second oil collecting space, wherein, on a top side, a housing of the oil pump has an opening connected with a delivery side of the second pump stage, and wherein oil suctioned out of the second oil collecting space is delivered by way of said opening directly into the first oil collecting space.

2. Oil catching device according to claim 1, wherein the opening is surrounded by a trough-shaped bordering.

3. Oil catching device according to claim 2, wherein the trough-shaped bordering forms a type of rising chimney for the oil.

4. Oil catching device according to claim 2, for an internal-combustion engine, comprising:

an oil catching housing which is arranged below a crankcase and which has at least two oil collecting spaces, in a first oil collecting space, an oil pump being arranged which has two pump stages, a first oil suction pipe reaching in the first oil collecting space in order to deliver lubricating oil by way of a delivery side of a first pump stage to consuming devices, and a second oil suction pipe connected with a second pump stage and leading to a second oil collecting space, wherein, on a top side, a housing of the oil pump has an opening surrounded by a trough-shaped bordering and connected with a delivery side of the second pump stage, wherein oil suctioned out of the second oil collecting space is delivered by way of said opening directly into the first oil collecting space, and wherein a pressure limiting valve is provided in the housing of the oil pump, said pressure limiting valve connected behind the delivery side of the first pump stage, the valve body of the pressure limiting valve monitoring a second opening which also discharges inside the trough-shaped bordering.

5. Oil pump for an internal-combustion engine for suctioning off lubricating oil situated in an oil catching device, comprising an oil pump housing in which at least two pairs of rear wheels or two pairs of rotors are arranged, by rotation of which, at least two pump stages are formed each having a suction side and a delivery side, wherein an opening forming a pressure-side outlet leads into a trough-shaped bordering shaped out of the oil pump housing, wherein a pressure limiting valve is provided in the housing of the oil pump, said pressure limiting valve connected behind the delivery side of a first of said pump stages, and wherein a valve body monitors a second opening which also discharges inside the trough-shaped bordering.

6. Oil pump according to claim 5, wherein the oil pump has two pairs of gear wheels.

7. Oil catching device for an engine, comprising:

an oil catching housing being arranged below a crankcase and having first and second oil collecting spaces, an oil pump arranged in the first oil collecting space and having first and second pump stages, a first oil suction pipe connected to the first pump stage and reaching in the first oil collecting space to operatively deliver oil via the first pump stage to consuming devices, and a second oil suction pipe connected to the second pump stage and reaching to the second oil collecting space, wherein on a top side of a housing of the oil pump, an opening is connected with a delivery side of the second pump stage, said opening operatively delivering oil suctioned out of the second oil collecting space directly into the first oil collection space.

* * * * *